US011015380B2

(12) United States Patent
Simonton

(10) Patent No.: US 11,015,380 B2
(45) **Date of Patent: *May 25, 2021**

(54) DEAD STOP TYPE PROJECTION WINDOWS WITH SEALANT DAMS FOR CONTROLLING FLOW OF SEALANT DURING INSTALLATION OF INSERT WINDOWS

(71) Applicant: David Brooks Simonton, Mineralwells, WV (US)

(72) Inventor: David Brooks Simonton, Mineralwells, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/275,839

(22) Filed: Feb. 14, 2019

(65) Prior Publication Data

US 2020/0263482 A1 Aug. 20, 2020

(51) Int. Cl.
*E06B 1/36* (2006.01)
*E06B 7/23* (2006.01)

(52) U.S. Cl.
CPC ..... *E06B 1/363* (2013.01); *E06B 1/366* (2013.01); *E06B 7/23* (2013.01)

(58) Field of Classification Search
CPC ..... E06B 1/363; E06B 1/366; E06B 7/23; E06B 7/2301; E06B 7/2305; E06B 7/2307; E06B 7/2309; E06B 7/231; E06B 7/16; E06B 7/21; E06B 7/22
USPC ..... 52/201
See application file for complete search history.

(56) References Cited

U.S. PATENT DOCUMENTS 1,152,899 A * 9/1915 Moore ..... E06B 7/28 47/40
1,214,057 A * 1/1917 Moore ..... E06B 7/28 47/40
1,804,787 A * 5/1931 Kullmer ..... E06B 7/22 49/489.1
2,074,872 A * 3/1937 Thorin ..... A47B 71/00 47/40
2,771,165 A * 11/1956 Bell ..... E06B 7/2301 52/717.02
3,067,845 A * 12/1962 Smith ..... E06B 1/363 52/456
3,074,125 A * 1/1963 Miller ..... E06B 1/363 52/63

(Continued)

*Primary Examiner* — Kyle J. Walraed-Sullivan
(74) *Attorney, Agent, or Firm* — Porter, Wright, Morris & Arthur, LLP

(57) ABSTRACT

A dead stop type projection window assembly includes a free-standing frame and at least one insert window. The free-standing frame includes a top member, a base member spaced below the top member, at least two mullions vertically extending between the top member and the base member and spaced apart to form an insert window opening therebetween, and a stop extending along a perimeter of the insert window opening. The insert window is secured to the free-standing frame at the insert window opening and is sealed at the stop with sealant to close the insert window opening. The free-standing frame also includes a sealant dam extending from the stop and engaging the insert window to resist flow of the sealant toward the window frame opening between the stop and the insert window.

20 Claims, 9 Drawing Sheets

(56) References Cited

U.S. PATENT DOCUMENTS 3,127,697 A * 4/1964 Romenko ..... E06B 7/28 47/40
3,148,479 A * 9/1964 D Amato ..... A01G 9/14 47/40
3,210,808 A * 10/1965 Creager ..... E04B 1/0046 52/204.705
4,132,035 A * 1/1979 Frambach ..... E06B 3/2605 49/381
4,251,964 A * 2/1981 Francis ..... E04D 3/08 52/204.593
4,314,424 A * 2/1982 Gordon ..... E06B 7/2312 49/400
4,497,137 A * 2/1985 Nelson ..... E06B 7/2314 49/495.1
4,571,899 A * 2/1986 Minter ..... E04D 3/14 52/395
4,663,896 A * 5/1987 Dunnick ..... E06B 1/363 52/201
4,686,805 A * 8/1987 Forslin ..... E04B 1/0046 49/DIG. 1
4,773,193 A * 9/1988 Biebuyck ..... E04B 1/0046 52/645
4,847,977 A * 7/1989 Gold ..... B60J 10/70 29/446
5,099,623 A * 3/1992 Smith ..... E06B 1/363 52/201
5,117,587 A * 6/1992 Doan ..... E06B 7/2309 49/383
5,356,694 A * 10/1994 Knapp ..... E06B 7/22 428/163
5,568,707 A * 10/1996 Ishikawa ..... E04B 1/0046 52/200
5,584,143 A * 12/1996 Kennedy ..... A47F 3/043 49/501
5,836,117 A * 11/1998 Johnson ..... E04B 1/0046 52/201
5,987,826 A * 11/1999 Petta ..... E06B 1/02 52/204.5
6,244,001 B1 * 6/2001 Anastasi ..... E06B 1/003 49/504
6,427,397 B1 * 8/2002 Kolaschnik ..... E06B 3/308 52/204.1
6,729,082 B1 * 5/2004 Oldham ..... E06B 1/363 52/201
2002/0014044 A1 * 2/2002 Edger ..... E06B 1/363 52/201
2012/0240492 A1 * 9/2012 Woodward ..... E06B 1/363 52/204.5
2016/0265270 A1 * 9/2016 Sawada ..... E06B 7/16
2018/0135347 A1 * 5/2018 Geier ..... E06B 7/2307

* cited by examiner

DEAD STOP TYPE PROJECTION WINDOWS WITH SEALANT DAMS FOR CONTROLLING FLOW OF SEALANT DURING INSTALLATION OF INSERT WINDOWS

CROSS-REFERENCE TO RELATED APPLICATIONS

Not Applicable

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to projection windows and, more particularly, to sealing insert windows in dead stop type projection windows.

BACKGROUND OF THE INVENTION

The new construction and replacement window industry has been manufacturing or outsourcing projection windows such as, for example but not limited to, bay and bow windows for many years. These bay and bow windows can be designed in different ways. The most common type of bay/bow window is a vinyl mulled or capped bay/bow window. Another type of bay/bow window which is commonly supplied by specialized outsourcing companies is a "dead stop" type bay and bow window.

The dead stop type bay/bow windows are particularly good for companies who outsource these specialty window products because the insert windows can be installed by anyone after the frame is built. Additionally, the dead stop type bay/bow windows are universal in that any manufacturer's standard windows can be installed into the frame as the insert windows. However, some manufacturers may decide to build this type of frame in house too, due to the products exceptional qualities over the vinyl mulled or capped type bay/bow windows. The vinyl mulled or capped type bay/bow window designs require the frame to be finished/sealed during or after the insert windows are installed into the frame. These types of designs typically have shortcomings.

A dead Stop type bay/bow window has individual insert windows that are each installed against an exterior and/or interior stop(s) of a frame. To seal the insert windows to the frame and the overall assembly against wind and water infiltration, the insert windows are caulked or other sealants are used to create a seal. Typically, sealants are first applied to the dead stops and then the insert windows are pushed into the sealant and against the dead stops (see FIGS. 1 and 2). The sealant can also be applied after installation of the insert windows or applied both before and after installation of the insert windows. The preferred and most common method is to apply sealant to the dead stops beforehand, install the insert windows against the dead stops, clean off the squeezed out sealant on the exterior, and then finally apply one last uniform bead of sealant on the exterior side of the frame after installation of the insert windows.

These current method(s) do a sufficient job of sealing the insert windows into the frame if done correctly. However, caulking and other sealants have drawbacks. The most notable drawbacks being that sealants can attract dirt, change color, suffer degradation, and require maintenance when exposed to the environment over time. Additionally, caulking and other sealants need to be applied correctly, are messy, and take a lot of time to clean and manipulate. Furthermore, caulking and other sealants are often not applied thoroughly enough or are not applied in the right areas which can lead to sealing issues for the completed bay/bow window in the field. To combat these application issues, installers must be trained and retained to control against sealant failures in the field.

Accordingly, there is a need in the art for improved dead stop type projection windows and/or methods for installing insert windows into window frames of dead stop type projection windows.

SUMMARY OF THE INVENTION

Disclosed are improved dead stop type projection windows and/or methods for installing insert windows into window frames of dead stop type projection windows which address one or more issues of the related art. Disclosed is a projection window assembly comprising, in combination, a free-standing frame and an insert window secured to the free-standing frame at an insert window opening. The free-standing frame includes a top member, a base member spaced below the top member, at least two mullions vertically extending between the top member and the base member and spaced apart to form the insert window opening therebetween, and a stop extending along at least a portion of a perimeter of the insert window opening. The insert window is secured to the free-standing frame at the insert window opening and is sealed at the stop with sealant to close the insert window opening. The free-standing frame further includes a sealant dam extending from the stop and engaging the insert window to resist flow of the sealant toward the window frame opening between the stop and the insert window.

Also disclosed is a projection window frame for receiving at least one independent insert window comprising, in combination, a top member, a base member spaced below the top member, at least two mullions vertically extending between the top member and the base member and spaced apart to form an insert window opening therebetween, and a stop extending along at least a portion of a perimeter of the insert window opening, A sealant dam extends from the stop and is configured to engage the insert window when the insert window is closing the insert window opening to resist flow of sealant from the stop toward the window frame opening between the stop and the insert window.

Further disclosed is a method of assembling a dead stop type projection window assembly comprising the steps of, in combination, obtaining an insert window and obtaining a free-standing frame including a top member, a base member spaced below the top member, at least two mullions vertically extending between the top member and the base member and spaced apart to form an insert window opening therebetween, a stop extending along at least a portion of a perimeter of the insert window opening, and a sealant dam extending from the stop for engaging the insert window to resist flow of sealant toward the window frame opening between the stop and the insert window. Applying a sealant along the stop adjacent the sealant dam and opposite the insert frame opening. Inserting the insert window into the free-standing frame at the insert window opening to engage the sealant and the sealant dam at the stop to close the insert window opening so that the sealant forms a seal between the insert window and the free-standing frame and the sealant dam resists flow of sealant toward the window frame opening between the stop and the insert window.

From the foregoing disclosure and the following more detailed description of various preferred embodiments it will be apparent to those skilled in the art that the present invention provides a significant advance in the technology and art of dead stop type projection windows and/or methods for installing insert windows into window frames of dead stop type projection windows. Particularly significant in this regard is the potential the invention affords for improving the seal between the insert windows and the window frame with major cost reduction and reduced labor requirements. Additional features and advantages of various preferred embodiments will be better understood in view of the detailed description provided below.

BRIEF DESCRIPTION OF THE DRAWINGS

These and further features of the present invention will be apparent with reference to the following description and drawings.

Figure 1:
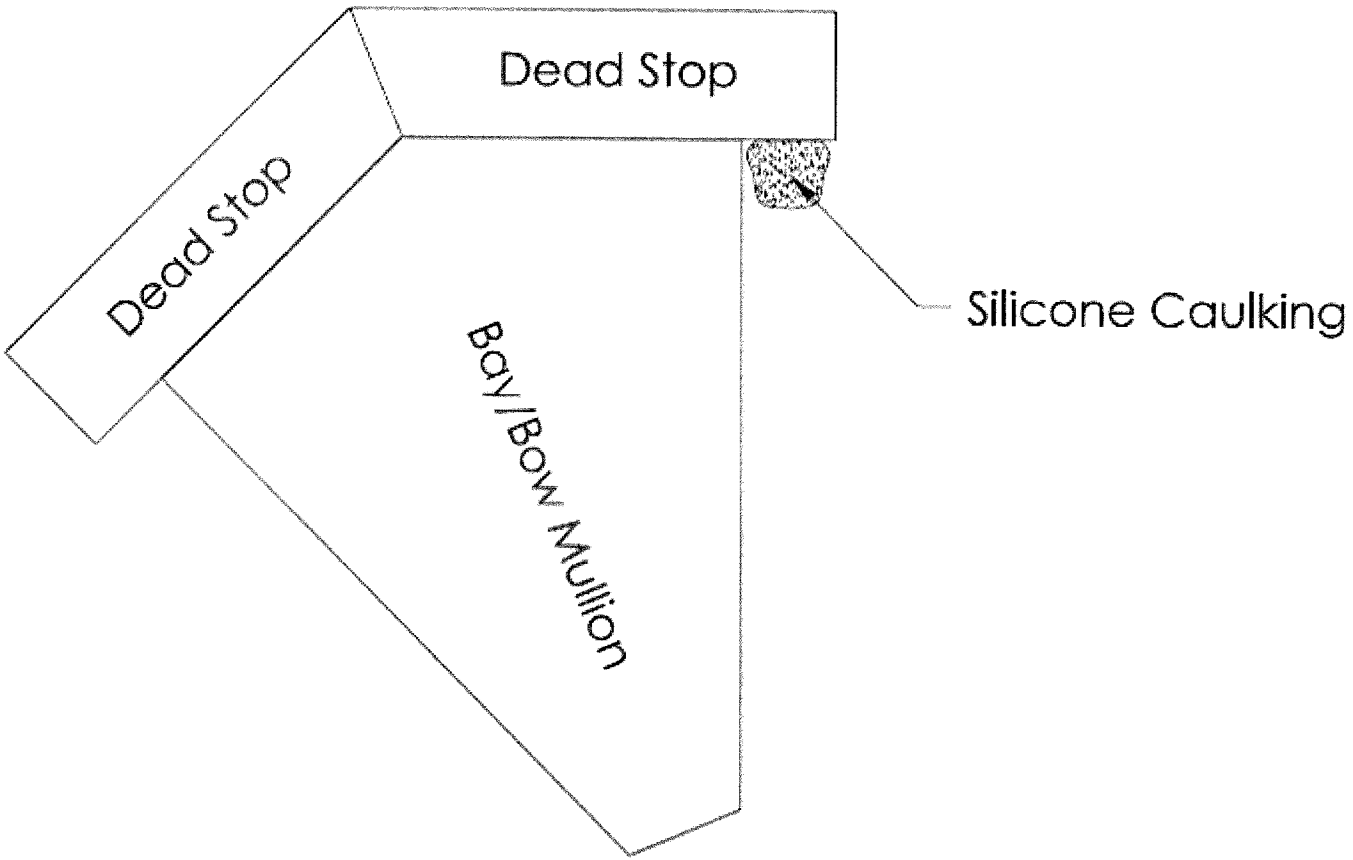
Figure 1 (Prior Art)
FIG. 1 is a diagrammatic top view showing a dead stop of a dead stop type bay/bow window frame according to the prior art.
Figure 2:
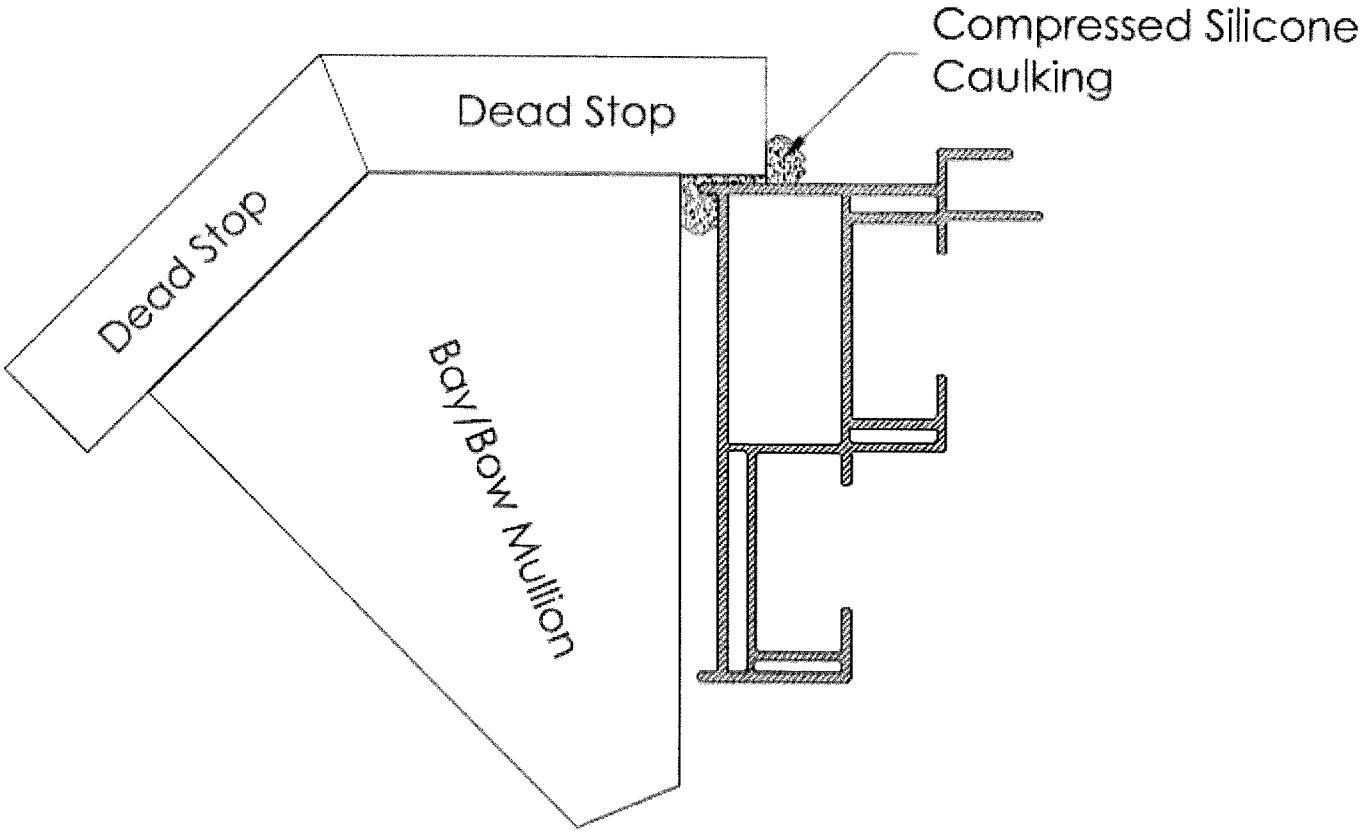
Figure 2 (Prior Art)
FIG. 2 is a diagrammatic top view showing the dead stop of FIG. 1 but wherein an insert window is installed against the dead stop to show where the sealant flows during installation.

It should be understood that the appended drawings are not necessarily to scale, presenting a somewhat simplified representation of various preferred features illustrative of the basic principles of the invention. The specific design features of the dead stop type bay/bow windows as disclosed herein, including, for example but not limited to, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example but not limited to, for clarity or illustration. All references to direction and position, unless otherwise indicated, refer to the orientation of the structures illustrated in the drawings. In general, up or upward generally refers to an upward direction within the plane of the paper in FIG. 3 and down or downward generally refers to a downward direction within the plane of the paper in FIG. 3. In general, front or forward generally refers to a direction into the plane of the paper in FIG. 3 and rear or rearward generally refers to a direction out of the plane of the paper in FIG. 3.

DETAILED DESCRIPTION OF CERTAIN PREFERRED EMBODIMENTS

It will be apparent to those skilled in the art, that is, to those who have knowledge or experience in this area of technology, that many uses and design variations are possible for the dead stop type projection window structures and methods related thereto that are disclosed herein. The following detailed discussion of various alternative and preferred embodiments will illustrate the general principles of the invention using an exemplar dead stop bay window. Other embodiments suitable for other applications will be apparent to those skilled in the art given the benefit of this disclosure such as, for example but not limited to, bow windows and other projection windows.

Referring now to the drawings, FIGS. 3 to 7 show a dead stop type projection window assembly 10 according a first embodiment of the present invention. The illustrated dead stop type projection window assembly 10 includes a free-standing frame 12 forming at least one insert window opening 14, and at least one insert window 16 secured to the free-standing frame 12 at the insert window opening 14 to generally close the insert window opening 14 in the free-standing frame 12. Sealant 18 is provided to fill or close at least a portion of any gap formed between the insert window 16 and the free-standing frame 12. The sealant 18 is preferably caulk or caulking. The free-standing frame 12 further includes at least one sealant dam or barrier 20 extending from a dead stop 22 for the insert window 16 and engaging the insert window 16 to control flow of the sealant 18 away from the insert window opening 14 and between the dead stop 22 and the insert window 16 during installation of the insert window 16 into the free-standing frame 12. That is, the sealant dam 20 resists the flow of the sealant 18 out of or through the insert window opening 14 during installation of the insert window 16 into the free-standing frame 12 so that there is only internal flow of the sealant 18 in a direction away from the insert window opening 14 to reduce or eliminate the need for cleaning sealant 18 squeezed out through the insert window opening 14.

The term "projection window" is used herein and in the claims to mean a window assembly that forms a three dimensional space or bay that extends or projects outward from a wall of a building such as, for example but not limited to, bay windows, bow windows, garden windows, oriel windows, and the like. The term "dead stop" or "stop" is used herein and in the claims to mean an internal or external abutment formed by the frame extending along at least a portion of the edge or perimeter of the insert window opening which the insert is pushed against during installation of the insert window to the frame. The term "sealant" is used herein and in the claims to mean a substance that is flowable during application and is used to block the passage of fluids through the gap between the dead stop and the insert window once cured. The term "caulk" or caulking" is used herein and in the claims to mean a flexible sealant used to close or fill gaps to prevent or reduce the passage of water, air, dust, insects, and/or noise therethrough and are often applied using a caulking gun or squeeze bottle. Most caulk or caulking currently sold is a ready-mixed construction chemical such as, for example but not limited to, silicone, polyurethane, polysulfide, sylil-terminated-polyether or polyurethane, acrylic, and the like and cures within about 24 hours.

Figure 3:
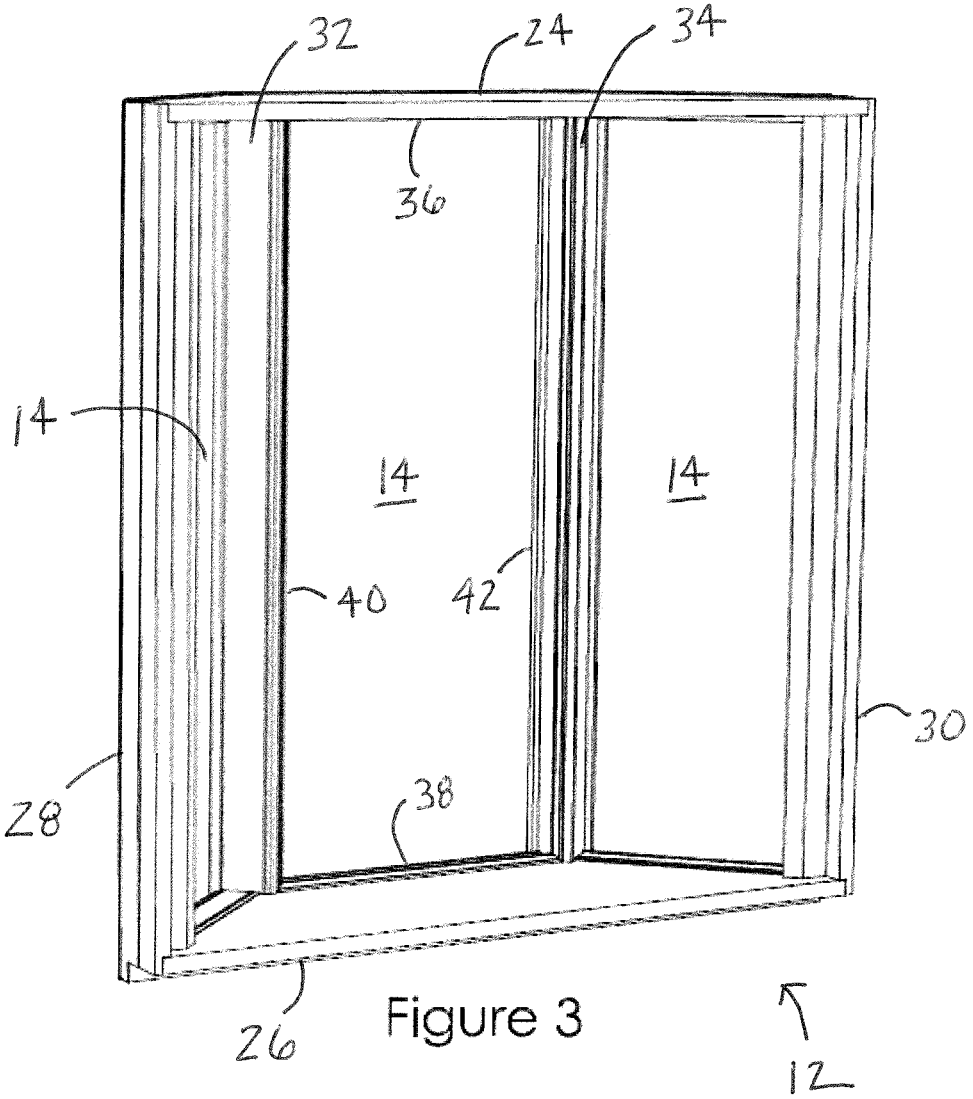
FIG. 3 is a perspective view showing a free-standing frame of a dead stop type bay window frame according to the present invention.
Figure 4:
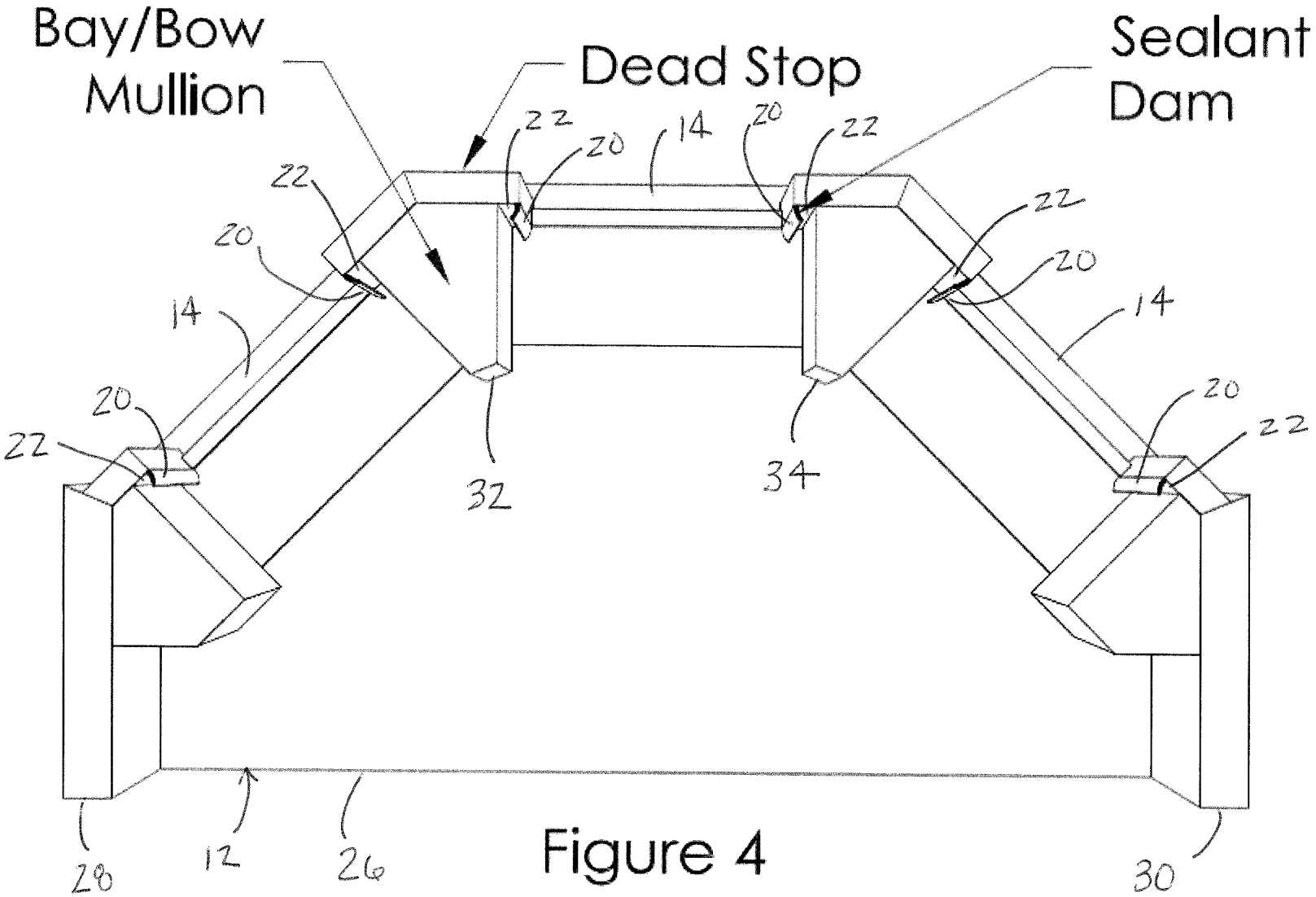
FIG. 4 is a fragmented sectional view of the free-standing frame of FIG. 3 at one opening for an insert window.
Figure 5:
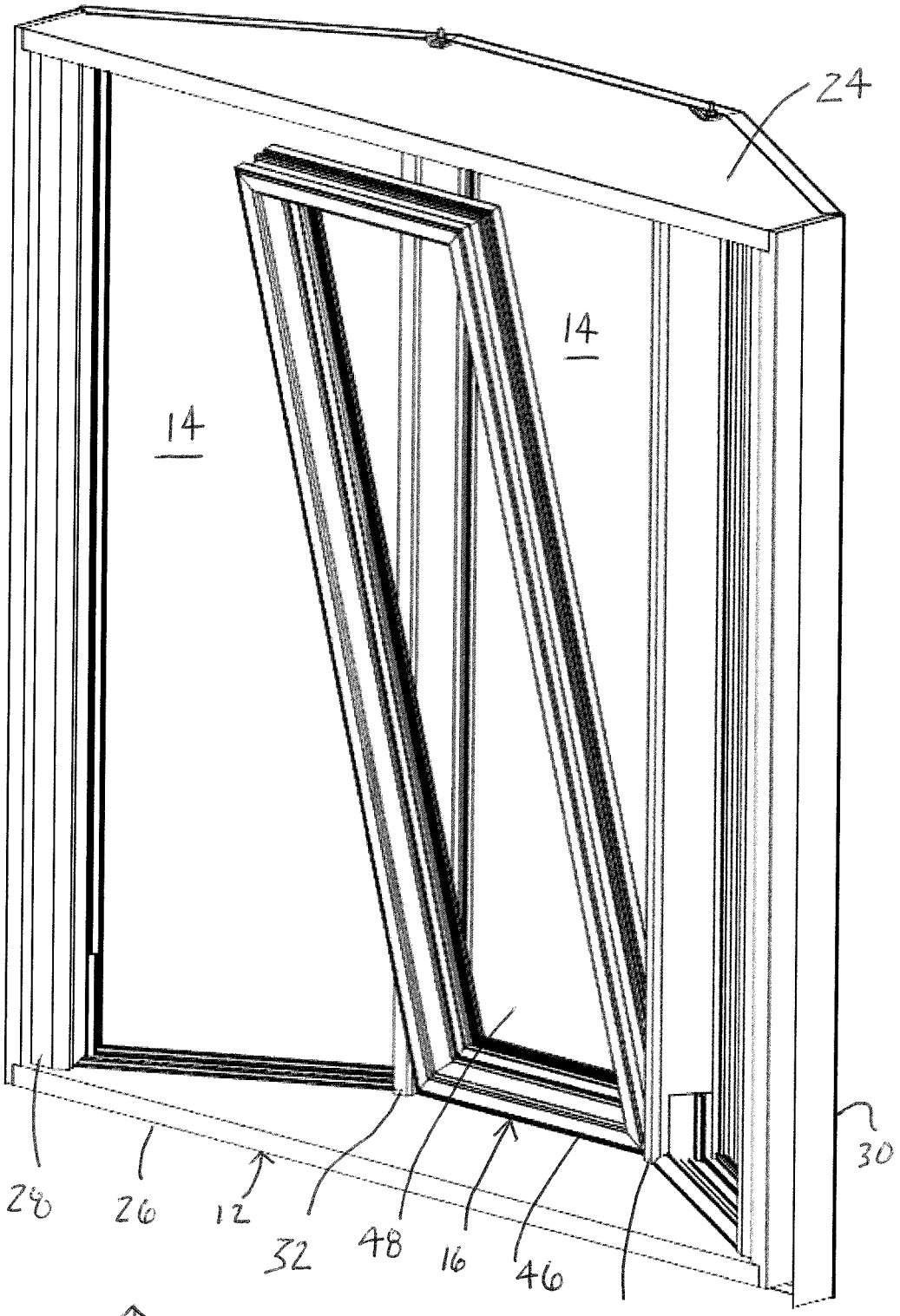
FIG. 5 is a diagrammatic view of the free-standing frame of FIG. 3 with an insert window being positioned into an opening of the frame.

As best seen in FIGS. 3 and 4, the illustrated free-standing frame 12 includes a top horizontally-extending structural member 24, a base or bottom horizontally structural member 26 spaced below the top structural member 24, vertically-extending left and right end structural members or mullions 28, 30 connecting left and right ends of the top and bottom structural members 24, 26, and two vertically-extending intermediate structural members or mullions 32, 34 connecting the top and bottom structural member members 24, 26 between the left and right end structural members 38, 30. The intermediate structural members 32, 34 are laterally spaced apart from each other and the left and right end structural members 28, 30 to form three laterally adjacent insert window openings 14 where the laterally outward or left and right side insert window openings 14 form an obtuse angle with the center insert opening 14. It is noted that other quantities of the intermediate structural members 23, 34 can be utilized to form other quantities of the insert window openings 14 such as for example but not limited to, one intermediate mullion 32, 34 to form two adjacent window openings 14, three intermediate mullions 32, 34 to form four insert window openings 14, and the like. The illustrated insert window openings 14 each have a rectangular shaped perimeter formed by horizontally-extending top and bottom edges 36, 38 connected by vertically-extending left and right edges 40, 42. It is noted that the insert window openings 14 can alternatively have any suitable configuration, size, and/or shape and are preferably sized and shaped to receive independent insert windows 16. The term "independent insert window" is used to mean a window that is a standard or off-the-shelf window that can be used independent of the free-standing frame 12 if desired such as, for example but not limited to, a standard window opening in a building exterior wall. The use of an independent insert window 16 enables the installer to select any suitable standard or off-the-shelf window to be used as the insert window 16 rather than being limited to using only a special insert window uniquely manufactured or customized to be used with the free-standing frame 12.

The illustrated free-standing frame 12 also includes the internal and rearward facing dead stops or stops 22 extending about the entire perimeter of the insert window openings 14. The illustrated dead stops 22 permit each of the insert windows 16 to be installed to the free-standing frame 12 from the interior side of the free-standing frame 12 and pushed against the dead stop 22 (best seen in FIG. 5). It is noted that the dead stops 22 can alternatively be external and outward facing to permit each of the insert windows 16 to be installed to the free-standing frame 12 from the exterior side of the free-standing frame 12. It is also noted that the dead stops 22 can have any other suitable configuration such as, for example but not limited to, extending along less than the entire perimeter of the insert window openings 14. The illustrated dead stops 22 are configured to form a seal with the insert window 16 with the sealant 18 located therebetween to seal closed the insert window opening 14. The illustrated dead stops 22 are each a planar surface parallel with the insert window opening 14 and have a width suitable for forming a seat and a seal for the insert windows 16 but any other suitable configuration can alternatively be utilized. The illustrated mullions 28, 30, 32, 34 form inwardly-extending walls 44 at edges of the dead stops 22 opposite the perimeter of the insert window openings 14. The illustrated walls 44 form acute angles with the dead stops 22 and form a gap or passage for the sealant 18 between the walls 44 and insert windows 16 as further described herein below.

The illustrated top structural member 24, bottom structural member 26, left and right end structural members or mullions 28, 30, and the intermediate structural members or mullions 32, 34 each comprise wood but any other suitable materials or combination of materials can be utilized such as for example but not limited to, aluminum or other suitable metals, nylon or other suitable polymers, and the like. The illustrated structural members 24-34 are solid and sized and shaped so that the frame 12 is free-stand or self-supporting. The illustrated dead stops 22 are formed by extrusions secured to the structural members 24-34. The illustrated extrusions are formed of vinyl and are attached by mechanical means such as, for example but not limited to, nails, screw, and the like. It is noted, however, that the extrusions can comprise any other suitable material and/or can be attached to the structural members 24-34 in any other suitable manner. It is also noted that the dead stops 22 can be formed in any other suitable manner.

Figure 6:
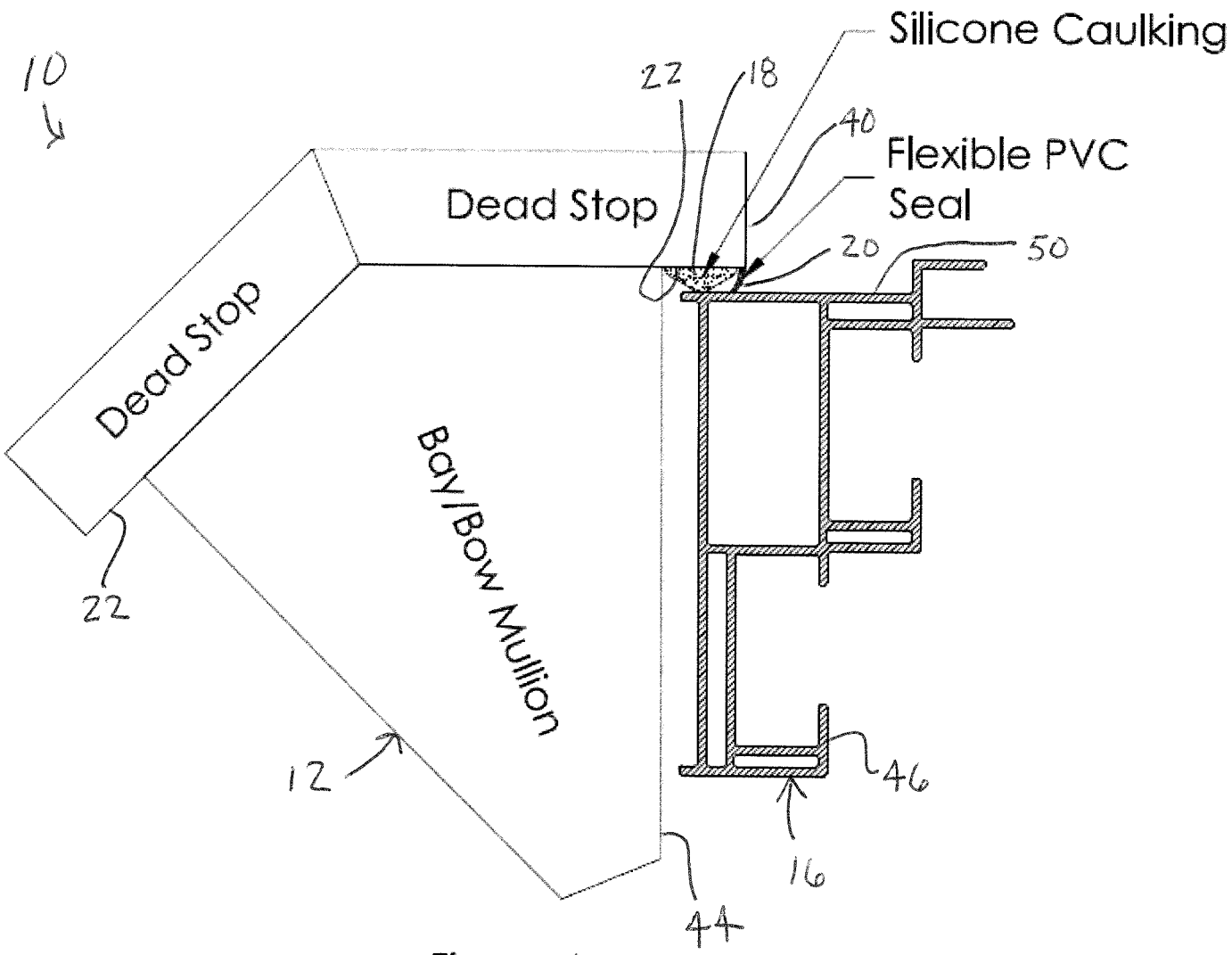
FIG. 6 is a diagrammatic top view showing a dead stop in the frame opening of FIG. 5, wherein a sealant dam is provided (in the form of a co-extruded flap seal) to control flow of sealant during installation of the insert window into the frame.
Figure 7:
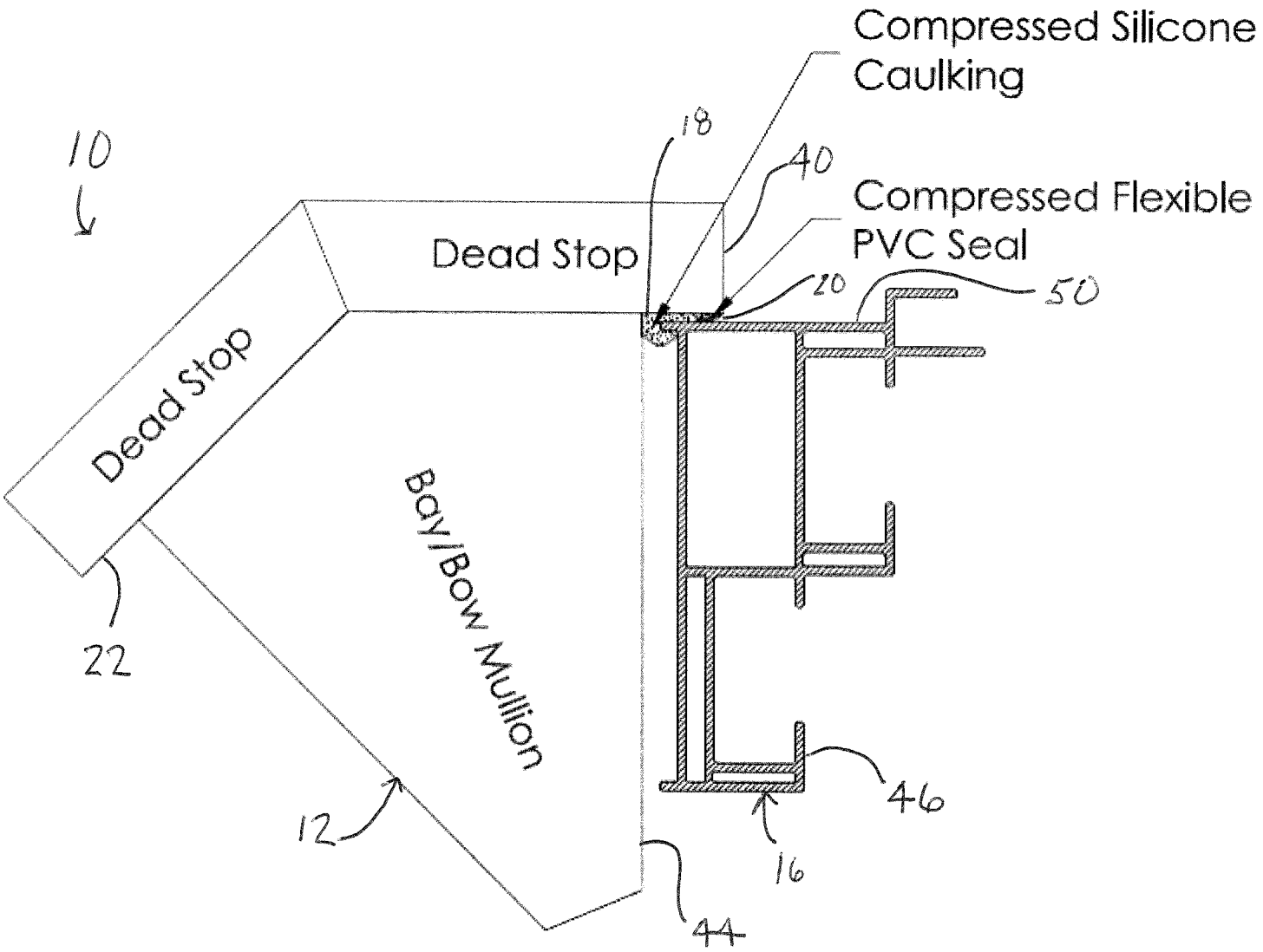
FIG. 7 is a diagrammatic top view showing the dead stop of FIG. 6 but wherein the insert window is fully installed against the dead stop and the sealant dam is blocking flow of sealant to the exterior while providing improved contact between the sealant and the face of the insert window.

As best seen in FIGS. 6 and 7, the illustrated sealant dams or barriers 20 each extend inwardly from the dead stop 2 toward the insert windows 16 and are adapted to engage the insert window 16 to form a seal therewith that resists and/or prevents sealant 18 from passing therebetween to the insert window opening 14. The illustrated sealant dam 20 is a flexible arch-shaped flap seal that bends when engaged by the insert window 16. The illustrated sealant dam 20 extends from a secured end located at or near the edge 36, 38, 40, 42 of the insert window opening 14 to a free end engaging the insert window 16 with a concave side facing the sealant 18. It is noted that any other suitable type of flexible member can alternatively be utilized to block the flow of sealant 18 such as, for example but not limited to, a compressible member that compresses when engaged by the insert window 16. A suitable compressible member is a foam gasket or the like. While the illustrated sealant dam 20 is arch shaped, the sealant dam 20 can alternatively have any suitable shape or combination of shapes such as, for example but not limited to, "D", square, rectangle, bulb, angled bulb, flaps, hollow bulb, foam filled bulb, hollow rectangle/square, foam filled rectangle/square, pile seals, sweeps, and the like.

The illustrated sealant dam 20 is coextruded with the dead stop 22 to form an integral one-piece component. However, the sealant dam 20 can alternatively be mounted or integrated in any suitable manner such as, for example but not limited to, direct extrusion, pre-applied, post applied, glued, stapled, adhesive mounted, slot mounted, and the like. The sealant dam 20 can comprise any suitable UV resistant, water resistant, water proof, and/or weather resistant material such as, for example but not limited to, EDPM rubber, Neoprene, Silicone, PVC, TPE (Thermoplastic Elastomers), Nitrile PVC, Silicone PVC, Nitrile, Foam, Q-lon Foam, polyethylene, urethane, and the like.

The illustrated dead stops 22 are provided with sealant dams 20 that extend along at least two edges 36, 38, 40, 42 of each of the insert window openings 14. The at least two edges 36, 38, 40, 42 are preferably the lateral left and right edges 40, 42 of each of the insert window openings 14. It is noted that the dead stops 22 can alternatively be provided with sealant dams 20 that extend along at least three edges 36, 38, 40, 42 of each of the insert window openings 14. The at least three edges 36, 38, 40, 42 are preferably at least the top, lateral left, and lateral right edges 36, 40, 42 of each of the insert window openings 14. It is further noted that the dead stops 22 can alternatively be provided with sealant dams 20 that extend along all four edges 36, 38, 40, 42 of each of the insert window openings 14, which are rectangular-shaped in the illustrated embodiments, to extend entirely around each of the insert window openings 14.

The insert windows 16 each include a rectangular-shaped window frame 46 extending about the periphery of at least one window pane 48. The window frame 46 forms an engagement surface 50 sized and shaped to cooperate with and be pushed against the dead stop 22 of the free-standing frame 12 during installation. The illustrated engagement surface 50 extends about the entire perimeter of the window frame 46 and is configured to form an air and water tight seal with the dead stop 22 via the sealant 18 located therebetween to seal closed the insert window opening 14. The illustrated engagement surface 50 is a planar surface substantially parallel with the dead stop 22 but any other suitable configuration can alternatively be utilized. The insert window 16 is preferably an independent insert window 16. Importantly, the illustrated sealant dam 20 does not require any different form or alteration of the insert windows 16.

Figure 8:
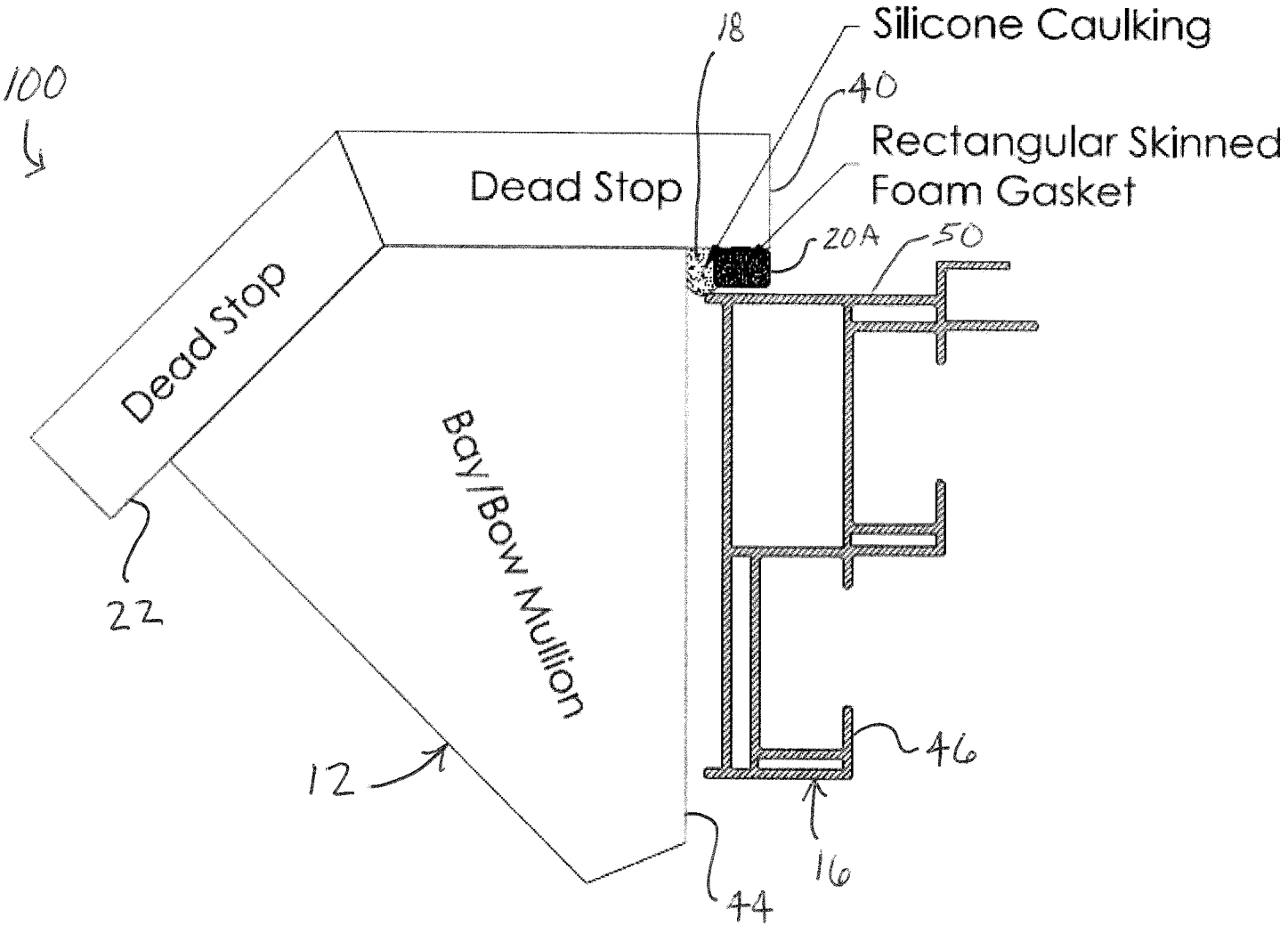
FIG. 8 is a diagrammatic top view showing the dead stop similar to FIG. 6 but according to an alternative embodiment of the present invention, wherein the sealant dam is in the form of a rectangular skinned foam gasket that controls flow of sealant during installation of an insert window.
Figure 9:
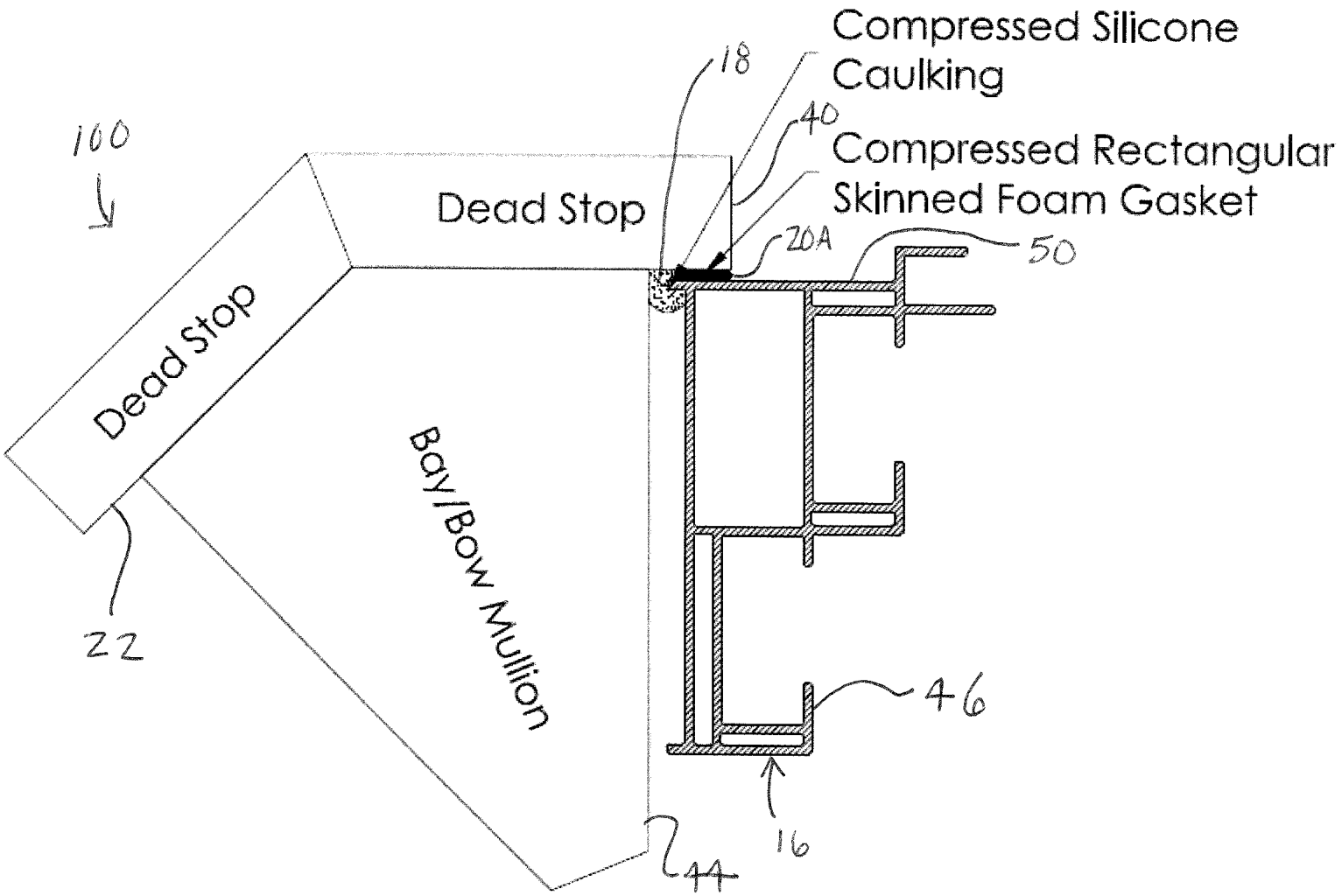
FIG. 9 is a diagrammatic top view showing the dead stop of FIG. 8 but wherein the insert window is fully installed against the dead stop and the sealant dam is blocking flow of sealant to the exterior while providing improved contact between the sealant and the face of the insert window.

FIGS. 8 and 9 show a dead stop type projection window assembly 100 according to a second embodiment of the present invention. The second embodiment of the present invention is substantially the same as the first embodiment described herein above except that the sealant dam 20A is a compressible member that compresses when pushed by the insert window 16 to form a seal rather than the above-described flexible member that bends when pushed by the insert window 16 to close the path of the sealant 18. The illustrated compressible member is a foam gasket or the like. It is noted that the compressible member can alternatively have any other suitable shape and can alternatively comprise any suitable material.

To install the insert windows 16 into the free-standing frame 12, the installer first places the sealant 18 along the dead stop 22 between the mullion wall 44 and the sealant dam 20. The sealant 18 can be a suitable caulk or any other suitable flowable sealant. The sealant 18 can be applied using a standard caulking gun and the installer can utilize the sealant dam 20 as a guide. The installer then inserts the insert window 16 into the free-standing frame 12 at the insert window opening 14 to engage the window engagement surface 50 with the sealant 18 and the sealant dam 20 on the dead stop 22 to close the insert window opening 14. The sealant 18 forms a seal between the insert window engagement surface 50 and the dead stop 22 of the free-standing frame 12. The sealant 18 also extends partially along the passage formed between the side of the window frame 46 and the wall 44 of the adjacent mullion 28, 30, 32, 34 to form a seal therebetween. The sealant dam 20 blocks the sealant 18 and resists flow of the sealant 18 toward and/or out of the insert window opening 14 between the dead stop 22 and the insert window 16 where the sealant 18 would otherwise pass to the exterior of the free-standing frame 12.

By providing the sealant dams or barriers 20 to control the flow of sealant 18, the overall performance, look, and ease of use of the dead stop type projection window is improved. The sealant dam 20 creates a barrier which closes the gap as the insert window 16 is pressed against the dead stop 22. In turn, the applied sealant 18 does not squeeze out to the exposed exterior of projection window assembly 10 and it flows to the inside of the projection window assembly 10 only. This control of the sealant flow helps to create a better more reliable seal that can extend around the entire perimeter of the insert window 16 due to all sealant flow moving in a controlled direction. If designed and applied appropriately, the sealant dam 20 will also produce a gap or space between the insert window 16 and the dead stop 22 for the sealant 18, unlike today's typical dead stop 22 installations which allow sealant 18 to squeeze entirely out of the face of the insert windows 16 during installation so that there is direct contact between the insert window 16 and the stop 22.

Additionally, the illustrated sealant dams 20 prevent the mess associated with traditional sealant 18 installations. Thus, installation time for the insert window 16 is reduced by 25% or more by the sealant dams 20. The illustrated sealant dams 20 thus make the application of sealant 18 both easier to do and much less messy. Furthermore, the installation no longer requires the clean-up and re-heading of sealant 18 on the exterior of the projection windows where the dead stops 22 and the insert window 16 meet.

Furthermore, the sealant dams 20 last much longer than exposed sealants 18 with no maintenance. The sealant 18 inside of the projection window assembly 10 is protected from exposure by the sealant dams 20 making the sealant last much longer. The sealant dams 20, depending on what material is used, also will not attract dirt or change colors over time to greatly improve the overall performance and look of the finished dead stop type projection window.

Moreover, the sealant dams 20 help mitigate the risk of improper sealing between the insert windows 16 and the dead stops 22. Less installer training, retention, and attention will be required over all using a sealant dam 20. The sealant dams 20 provide an easier and better performing insert window 16 installation overall. The sealant dams 20 require less oversight, attention to application and much less time per bay or bow window during installation of the insert windows 16.

Any of the features or attributes of the above the above described embodiments and variations can be used in combination with any of the other features and attributes of the above described embodiments and variations as desired.

It is apparent from the above detailed description of preferred embodiments of the present invention, that the above-disclosed dead stop type projection window assemblies 10, and the method for forming the dead stop type projection window assemblies 10, reduces or eliminates messy installations, improves on product performance, cuts installation time dramatically, and eliminates exposed exterior sealant that fails and requires maintenance.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A dead-stop projection window assembly comprising, in combination:

a free-standing frame including:

a top member;

a base member spaced below the top member;

at least two mullions vertically extending between the top member and the base member and spaced apart to form an insert window opening therebetween; and an internal and rearward-facing dead stop extending entirely about a perimeter of the insert window opening;

an independent insert window including a window frame extending about at least one window pane;

wherein the independent insert window is an off-the shelf window;

wherein the window frame of the independent insert window is secured to the free-standing frame at the insert window opening of the free-standing frame to prevent movement between the window frame and the free-standing frame and sealed at the internal and rearward-facing dead stop with sealant to close the insert window opening with the independent insert window; and wherein the free-standing frame further includes at least one sealant dam extending from at least a portion of the internal and rearward-facing dead stop of the free-standing frame and engaging the window frame of the independent insert window to resist flow of the sealant toward the window frame opening between the internal and rearward-facing dead stop and the window frame of the independent insert window.

2. The dead stop projection window assembly according to claim 1, wherein the at least one sealant dam is a flexible member bent between the internal and rearward-facing dead stop and the independent insert window.

3. The dead stop projection window assembly according to claim 2, wherein the at least one sealant dam is a flap seal.

4. The dead stop projection window assembly according to claim 1, wherein the at least one sealant dam is a compressible member that compresses when engaged by the independent insert window.

5. The dead stop projection window assembly according to claim 4, wherein the at least one sealant dam is foam gasket.

6. The dead stop projection window assembly according to claim 1, wherein the at least one sealant dam is co-extruded with the dead stop.

7. The dead stop projection window assembly according to claim 1, wherein the at least one sealant dam is attached to the internal and rearward-facing dead stop.

8. The dead stop projection window assembly according to claim 1, wherein the sealant is caulking.

9. The dead stop projection window assembly according to claim 1, wherein the insert window opening of the free-standing frame is rectangular, there are at least two of the at least one sealant dam, and the at least two sealant dams extend along at least two edges of the insert window opening.

10. The dead stop projection window assembly according to claim 9, wherein the at least two sealant dams extend along at least lateral left and right edges of the insert window opening.

11. The dead stop projection window assembly according to claim 1, wherein the sealant dam produces a gap for the sealant between the window frame of the independent insert window and the internal and rearward-facing dead stop of the free-standing frame.

12. A method of assembling a dead stop projection window assembly comprising the steps of, in combination:

obtaining an independent insert window including a window frame extending about at least one window pane, wherein the independent insert window is an off-the shelf window;

obtaining a free-standing frame including a top member, a base member spaced below the top member, at least two mullions vertically extending between the top member and the base member and spaced apart to form an insert window opening therebetween, an internal and rearward-facing dead stop extending entirely about a perimeter of the insert window opening; and at least one sealant dam extending from at least a portion of the internal and rearward-facing dead stop for engaging the independent insert window to resist flow of sealant toward the window frame opening between the internal and rearward-facing dead stop and the independent insert window;

applying sealant along the internal and rearward-facing dead stop of the free standing frame adjacent the at least one sealant dam and opposite the insert frame opening;

inserting the independent insert window into the free-standing frame at the insert window opening of the free standing frame to engage the window frame of the independent insert window with the sealant and the at least one sealant dam at the internal and rearward-facing dead stop to close the insert window opening so that the sealant forms a seal between the window frame of the independent insert window and the free-standing frame and the at least one sealant dam resists flow of sealant toward the window frame opening between the internal and rearward-facing dead stop of the free-standing frame and the window frame of the independent insert window; and securing the window frame of the independent insert window to the free-standing frame at the insert window opening of the free-standing frame to close the insert window opening with the independent insert window and the sealant sealing the insert window opening between the window frame and the internal and rearward-facing dead stop.

13. The method according to claim 12, wherein the at least one sealant dam is a flexible member that bends when engaged by the independent insert window.

14. The method according to claim 13, wherein the at least one sealant dam is a flap seal.

15. The method according to claim 12, wherein the at least one sealant dam is a compressible member that compresses when engaged by the independent insert window.

16. The method according to claim 15, wherein the at least one sealant dam is foam gasket.

17. The method according to claim 12, wherein the at least one sealant dam is co-extruded with the internal and rearward-facing dead stop.

18. The method according to claim 12, wherein the sealant is caulking.

19. The method according to claim 12, wherein the insert window opening of the free-standing frame is rectangular, there are at least two of the at least one sealant dam, and the at least two sealant dams extend along at least two edges of the insert window opening.

20. The method according to claim 12, wherein the sealant dam produces a gap for the sealant between the window frame of the independent insert window and the internal and rearward-facing dead stop of the free-standing frame.

* * * * *